United States Patent [19]

Odlum

[11] Patent Number: 5,001,612

[45] Date of Patent: Mar. 19, 1991

[54] FLASHLIGHT ATTACHMENT

[76] Inventor: Christopher Odlum, 1346 Lee St., SE., Salem, Oreg. 97302

[21] Appl. No.: 445,044

[22] Filed: Dec. 4, 1989

[51] Int. Cl.[5] ..... F21L 7/00

[52] U.S. Cl. ..... 362/187; 362/186; 362/190; 362/255

[58] Field of Search ..... 362/157, 186, 187, 190, 362/191, 255

[56] References Cited

U.S. PATENT DOCUMENTS

| | | | |
|---|---|---|---|
| 1,248,688 | 12/1917 | Ludescher | 362/186 |
| 1,904,248 | 4/1933 | Pixley et al. | 362/186 |
| 2,273,360 | 2/1942 | Kidder | 362/187 |
| 4,004,132 | 1/1977 | Glass et al. | 362/186 |
| 4,225,907 | 9/1980 | Erdell | 362/255 |
| 4,740,874 | 4/1988 | Wylie | 362/268 |
| 4,782,433 | 11/1988 | Rombough | 362/186 |
| 4,792,883 | 12/1988 | Ackerman et al. | 362/190 |

*Primary Examiner*—Ira S. Lazarus
*Assistant Examiner*—Sue Hagarman

[57] ABSTRACT

An attachment for a flashlight for changing a narrow beam light output into a wide beam output. A hollow three dimensional reflector intercepts light rays coming from the flashlight, and redirects such rays into a series of fan-shaped patterns measured in radial planes containing the flashlight axis. A small central opening in the reflector transmits some rays in the forward (axial) direction. The attachment is useful during camping trips for illuminating the space within a tent enclosure.

5 Claims, 1 Drawing Sheet

FLASHLIGHT ATTACHMENT

BACKGROUND AND SUMMARY OF THE INVENTION

This invention relates to a light diffusing attachment for flashlights. The attachment is designed to change the light pattern of a conventional flashlight from a relatively narrow single-direction beam into a relatively diffuse radiating beam.

The invention is useful when it is desired to illuminate a three dimensional volumetric space, as distinguished from a single narrow zone. For example, when camping it would be desirable to illuminate the space within the interior of a tent enclosure, using only a conventional flashlihgt (thereby avoiding the need to buy or pack a lantern). Also, in the case of power outages it would be desirable to use a flashlight to illuminate a room in an otherwise darkened house.

The attachment of the present invention includes a small convex parabolic (or curved) reflector oriented on the flashlight axis to intercept light rays coming out of the flashlight. The reflector surface redirects the light rays radially away from the flashlight axis in an infinite number of fan-shaped patterns (measured within radial planes containing the flashlight axis). With the flashlight in a suspended (hanging) position light rays will be directed radially in all directions. The rays will have vertical components, such that areas near the floor and also near the ceiling are illuminated. A small opening is provided at a central point on the parabolic reflector to transmit some light to the central zone below the flashlight. The flashlight acts as a three dimensional light source having light radiating features similar to those of a lantern.

The flashlight attachment does not interfere with portability of the flashlight. Therefore the flashlight (with the attachment secured thereto) can be manipulated by hand in conventional fashion, to provide a very wide light beam for illumination of large spatial areas, as distinguished from the small areas that are capable of illumination with conventional flashlights. Because a large spatial area is illuminated the attachment could be used as a person locator device in wilderness situations (to indicate to others the fact that the person holding the flashlight is in the area).

THE DRAWINGS

DESCRIPTION OF A PREFERRED EMBODIMENT OF THE INVENTION

Figure 1:
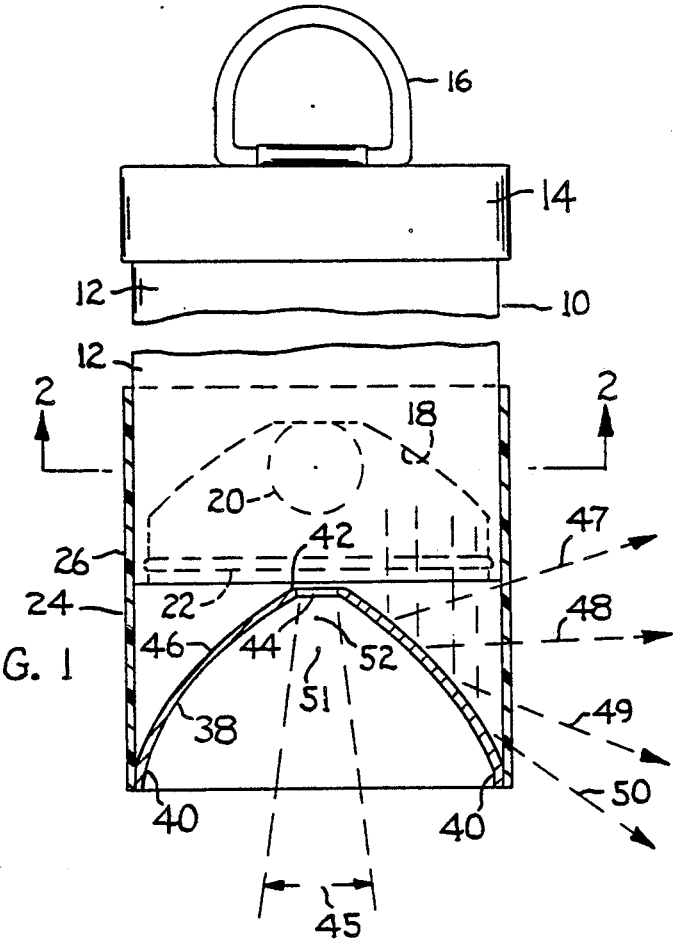
FIG. 1 is a sectional view through a flashlight attachment embodying the invention. The associated flashlight is shown fragmentarily.
Figure 2:
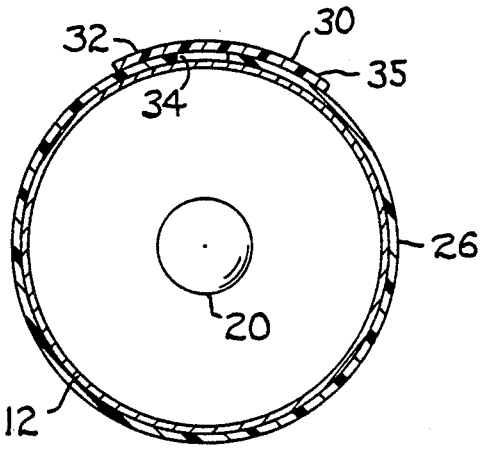
FIG. 2 is a sectional view taken on line 2—2 in FIG. 1.

FIG. 1 fragmentarily shows a conventional flashlight 10 that includes a tubular side wall 12 closed at one end by a screw cap 14. A bail (handle) 16 is pivotably attached to cap 14 for suspension of the flashlight from a non-illustrated support. At its other (lower) end tubular wall 12 carries a parabolic reflector 18; a spherical light bulb 20 has electrical terminals extending through a central hole in reflector 18 to electrically connect with one or more dry cell batteries contained within tubular wall 12. A transparent window 22 closes the space occupied by the light bulb. Flashlight 10 is of conventional construction. In a typical case tubular wall 12 would have a diameter on the order of two inches. Usually a manual switch is provided at some point along wall 12 to control current flow between the dry cell batteries and bulb 20.

My invention relates to a light diffusing attachment designated generally by numeral 24. The attachment includes a transparent cylindrical tube 26 adapted to fit over the end of the flashlight so that approximately one half of the tube 26 length encircles wall 12 of the flashlight, and approximately one half the tube 26 length protrudes beyond the end of the flashlight. Transparent tube 26 is preferably formed of a semi-flexible plastic material that can deform (or reform) to fit snugly around the surface of the flashlight side wall, for thus firmly (but removably) securing the attachment to the flashlight.

In order to make tube 26 more tightly fit onto the flashlight the tube can be provided with a tightener strap 30 that extends partially around the tube outer surface near the upper end of the tube (as the tube is viewed in FIG. 1). The left end 32 of the strap is adhesively attached to tube 26 near one edge of an axial slot 34 in the tube wall. Slot 34 extends axially from the upper end of tube 26 at least one half the length of the tube, such that the tube section in physical contact with the flashlight surface can be reformed to a smaller diameter (by narrowing the width of slot 34).

The other end area 35 of strap 30 is detached from tube 26. However, the confronting surfaces of strap area 35 and tube 26 are surfaced with miniature interlocking hook and loop materials available under the tradename VELCRO. By first exerting a transverse pulling force on strap 30 and then forcing strap area 35 toward tube 26 it is possible to lock tube 26 firmly in place on the flashlight.

A hollow annular three dimensional reflector 38 is disposed within the protruding section of transparent tube 26. Reflector 38 includes an annular cylindrical peripheral end surface 40 adhesively attached to the extreme internal end surface area of tube 26, such that the tube serves as a mounting member for the reflector. Reflector 38 converges from peripheral surface 40 toward the flashlight axis to form a small transverse apex wall 42 in near proximity to the flashlight window 22. A relatively small circular opening 44 extends through apex wall 42 to transmit a relatively narrow beam of light predominately in the area designated by numeral 45. Some light will exist laterally beyond zone 45. Opening 44 has a diameter about one-half the diameter of bulb 20, such that only a fraction of the light generated by the bulb is transmitted through opening 44.

The upper convex surface 46 of reflector 38 has a silver coating thereon facing flashlight reflector 18. Reflective surface 46 diverges from apex wall (surface) 42 as it extends toward peripheral mounting surface 40. Surface 46 is convexly curved for a substantial portion of its length, as viewed in FIG. 1, so that incident light rays coming from the flashlight are redirected outwardly in fan-shaped patterns. FIG. 1 shows four representative rays 47, 48, 49 and 50 having imaginary origination (focal) points 51 and 52 located on the flashlight axis. Rays 47 and 48 have a common focal point 51. Rays 49 and 50 have a common focal point 52.

The directions taken by the reflected light rays are determined by the contour of reflective surface 46. Surface 46 preferably has a parabolic contour for the major portion of its length (as viewed in radial planes containing the flashlight axis). The portion of surface 46 in near proximity to apex wall 42 may be essentially frusto-conical in nature to produce the light ray 47 (which has a predominately radial component with a minor upward component). The portion of surface 46 in near proximity to mounting surface 40 has a pronounced axial component so that the generated ray 50 has a predominate downward component (when the flashlight is suspended in a vertical orientation).

FIG. 1 shows one representative set of light rays produced in one radial plane containing the flashlight axis, i.e. the plane of the paper in FIG. 1. It will be understood that the same light pattern is produced around the entire spatial area surrounding the flashlight. Reflector 38 is symmetrical around the flashlight axis.

The illustrated attachment can be used in a camping tent to effectively illuminate substantially the entire interior tent space. With flashlight 10 suspended from a central portion of the tent ceiling the light rays generated at reflector surface 46 will illuminate remote zones of the tent near the tent ceiling and also remote zones near the tent floor. Central opening 44 will transmit light rays downwardly into the central zone below the flashlight. A fairly uniform illumination of the entire tent interior space will be achieved.

The major diameter of the three dimensional reflector (measured across the lower end area 40 of the reflector) is greater than the axial length of the reflector so as to produce the predominately radial rays 48 and 49 that illuminate remote areas of the tent (or room when the attachment is used as a temporary light source during power outages).

U.S. Pat. No. 4,740,874 to B. Wylie shows a flashlight attachment that is in some respects similar to the herein proposed attachment. However the reflector in the Wylie patented arrangement has a conical surface contour, such that light is reflected in a single relatively narrow conical beam pattern different than the pattern produced by my parabolic reflector surface. The Wylie patented arrangement lacks a central opening corresponding to opening 42 in my proposed arrangement. The Wylie patented arrangement functions as a hazard signal light, as opposed to the illuminating function of my attachment.

I claim:

1. A light diffusing attachment for a flashlight wherein the flashlight includes a tubular side wall (12), a concave reflector (18) near one end of said tubular side wall, a window (22) closing said one end of the tubular side wall, and a light bulb (20) located on the axis of the tubular side wall within the space between the reflector and the transparent window: said light diffusing attachment comprising a transparent tube (26) adapted to fit over said one end of the flashlight in axial alignment with the flashlight bulb; said tube having a substantial section thereof protruding beyond the transparent window of the flashlight to form a cylindrical mounting surface; a hollow annular three dimensional reflector disposed within the protruding section of the transparent tube, said three dimensional reflector having convex light-reflecting surfaces that face the flashlight symmetrically around the flashlight axis; said three dimensional reflector including an annular peripheral end surface affixed to the cylindrical mounting surface formed by the tube, a transverse apex surface axially aligned with the bulb in the flashlight, and a convexly curved divergent surface extending axially and radially from said apex surface to said annular peripheral surface; a circular light-transmitting opening through said apex surface for passing light rays from the flashlight in a generally axial direction, said opening having a diameter smaller than the diameter of the bulb in the flashlight so that only a fraction of the light generated in the bulb passes through said opening; said convexly curved divergent surface having a changing radius of curvature in radial planes containing the flashlight axis, whereby light is reflected radially outwardly from the divergent surface through the transparent tube in fan-shaped patterns measured within said radial planes.

2. The attachment of claim 1, wherein said opening has a diameter that is approximately one half the diameter of the bulb in the flashlight.

3. The attachment of claim 1, wherein said transparent tube has a substantial portion of its length adapted to slip over the side surface of the flashlight.

4. The attachment of claim 3, wherein said transparent tube has an axial slot extending therealong to facilitate installation of the tube onto the flashlight.

5. The attachment of claim 4, and further comprising a transversely extending flexible strap spanning the slot to constrict the tube around the flashlight; said strap and tube having confronting surfaces thereof faced with miniature interlocking hook and loop materials.

* * * * *